United States Patent [19]

Henderson

[11] 4,436,214

[45] Mar. 13, 1984

[54] ANTI-THEFT PICNIC DEVICE

[76] Inventor: David Henderson, 14 Chester Rd., Darien, Conn. 06820

[21] Appl. No.: 450,987

[22] Filed: Dec. 20, 1982

[51] Int. Cl.[3] ..... B65D 25/24; E02D 5/80

[52] U.S. Cl. ..... 220/18

[58] Field of Search ..... 220/18; 52/159, 160, 52/161, 162, 165

[56] References Cited

U.S. PATENT DOCUMENTS

| | | | |
|---|---|---|---|
| 1,109,478 | 9/1914 | Steadman, Jr. | 52/162 |
| 1,907,811 | 5/1933 | Hollos | 52/162 X |
| 2,431,609 | 11/1947 | Clapper | 52/161 |
| 2,580,948 | 1/1952 | Pancake | 52/161 X |
| 2,613,010 | 10/1952 | Atkinson | 220/18 |
| 2,863,535 | 12/1958 | Clapper | 52/161 |
| 3,012,644 | 12/1961 | Bush | 52/162 |

*Primary Examiner*—Steven M. Pollard
*Attorney, Agent, or Firm*—Curtis, Morris & Safford

[57] ABSTRACT

A secure beach picnic chest assembly includes a lockable picnic chest and a centrally-disposed anti-theft anchoring device that extends through a through opening in the floor of the chest and can be pushed downwardly to become embedded in sand or soft soil. By turning an actuator handle at the top of the anchoring device, a plurality of anchoring members thereon can be moved between first and second positions. In their first positions, the anchoring members are disposed against the outside of a peripheral wall of the member, so that the member can be inserted into or withdrawn from the sand or soft soil. In their second positions, the anchoring members are angled outwardly from the peripheral wall for anchoring the anti-theft member and the picnic chest to prevent the latter from being carried away by casual thieves. The combination is useful, for example, at a beach, where food, clothes, and valuables can be placed in the chest, and the lid thereof can be secured by a lock, permitting the entire party of picnickers or bathers to leave the chest unattended and go swimming.

13 Claims, 4 Drawing Figures

ANTI-THEFT PICNIC DEVICE

BACKGROUND OF THE INVENTION

This invention relates to hand-portable containers, such as picnic chests suitable for use at the beach. This invention also relates to anchor members suitable for securing objects, such as picnic chests, to sand or soft soil.

At the present time, if a group of picnickers goes on an outing, for example, to a beach or other picnic area, it is common to bring along one or more portable picnic chests containing food, beach clothing, or other items. Once the party arrives at the beach or picnic location, the chest can be used as a receptacle for clothing and valuables while the persons are off enjoying themselves. For instance, property can be stored in the chest on the beach while the persons are in the water. However, because these picnic chests are so easy to carry, it is advisable that at least one person in the party remain in the vicinity when the rest of the party is swimming, because otherwise it would be tempting for casual thieves to carry away the picnic chest together with any valuables that may be locked inside.

While it would be desirable to secure the picnic chest to some permanent structure on the beach, quite often no suitable structure is available.

Furthermore, no one has previously proposed any means for anchoring a picnic chest directly to the sand or to other similar soft soil in a fashion that would provide security from casual theft.

OBJECTS AND SUMMARY OF THE INVENTION

Accordingly, it is an object of this invention to provide, in combination, a picnic chest with a locking lid suitable for storing valuables inside while at the beach or in a picnic area, and an anchoring device coupled to the bottom of the picnic chest and which can be actuated by means of a member within the chest for securing the device and the picnic chest by anchoring the device to the sand or soil.

It is another object of this invention to provide a novel locking spike assembly of the type which can be inserted into soft soil or sand and selectively anchored therein.

According to a novel aspect of this invention, there is provided a securable beach picnic chest assembly combination including a picnic chest having a floor, a closable lid, and locking means for locking the lid, with the chest being sufficiently light in weight to be hand-portable, and with the floor thereof having a centrally-disposed through opening; and a locking spike device extending down through the through opening for anchoring the picnic chest on the sand or other soft soil which may be found, for example, on a beach. The locking spike device can include a body portion, an insertion point at a lower end of the body portion, a shoulder at an upper end of the body portion mating, for example, with a recess in the chest for securing the picnic chest to the locking spike device, a plurality of locking spikes having at least anchoring portions thereof disposed outside the body portion, slide means within the body portion coupled to the locking spikes and displaceable between first and second operative positions, and an actuator handle within the picnic chest for selectively displacing the slide means to its first and second positions. In the first position of the slide means, the anchoring portions of the locking spikes are disposed against the body portion so that the locking spike device can be inserted into and withdrawn from the sand or soft soil, while, in the second position of the slide means, the anchoring portions of the locking spikes are angled outwardly from the body portion to anchor the locking spike device and picnic chest in place in the sand or soft soil.

The foregoing and many other objects, features, and advantages of this invention will become apparent from the ensuing detailed description of a preferred embodiment thereof, when considered in connection with the accompanying drawings.

DETAILED DESCRIPTION OF A PREFERRED EMBODIMENT

Figure 1:
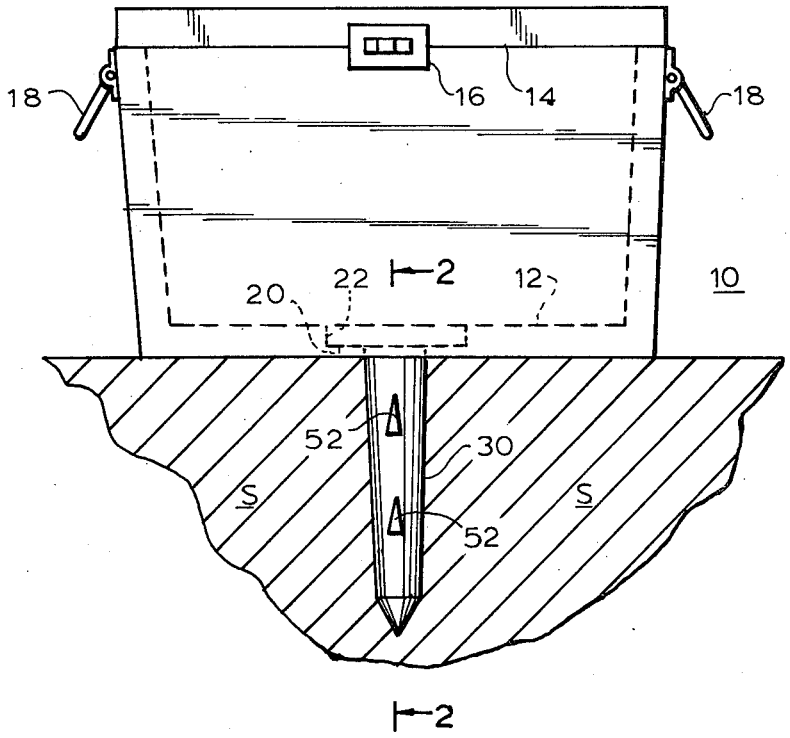
FIG. 1 is a front elevational view of one embodiment of a combination picnic chest and locking spike assembly according to this invention.

With reference to the drawings, initially FIG. 1 thereof, an embodiment of this invention includes a picnic chest 10, which can favorably be a cooler or ice chest. The chest 10 is preferably constructed of rigid, sturdy light-weight material. The chest 10 has a bottom or floor 12 and has a lid 14 which can be locked closed by means of a combination lock 16. Handles 18 are provided for carrying the chest 10.

A through opening 20 extends through a central portion of the floor 12 of the chest 10 and a disk-shaped recess 22 is provided therein concentric with the through the opening 20. A locking spike device 30 extends downward through opening 20 into soft soil or sand S on which the picnic chest 10 is sitting.

Figure 2:
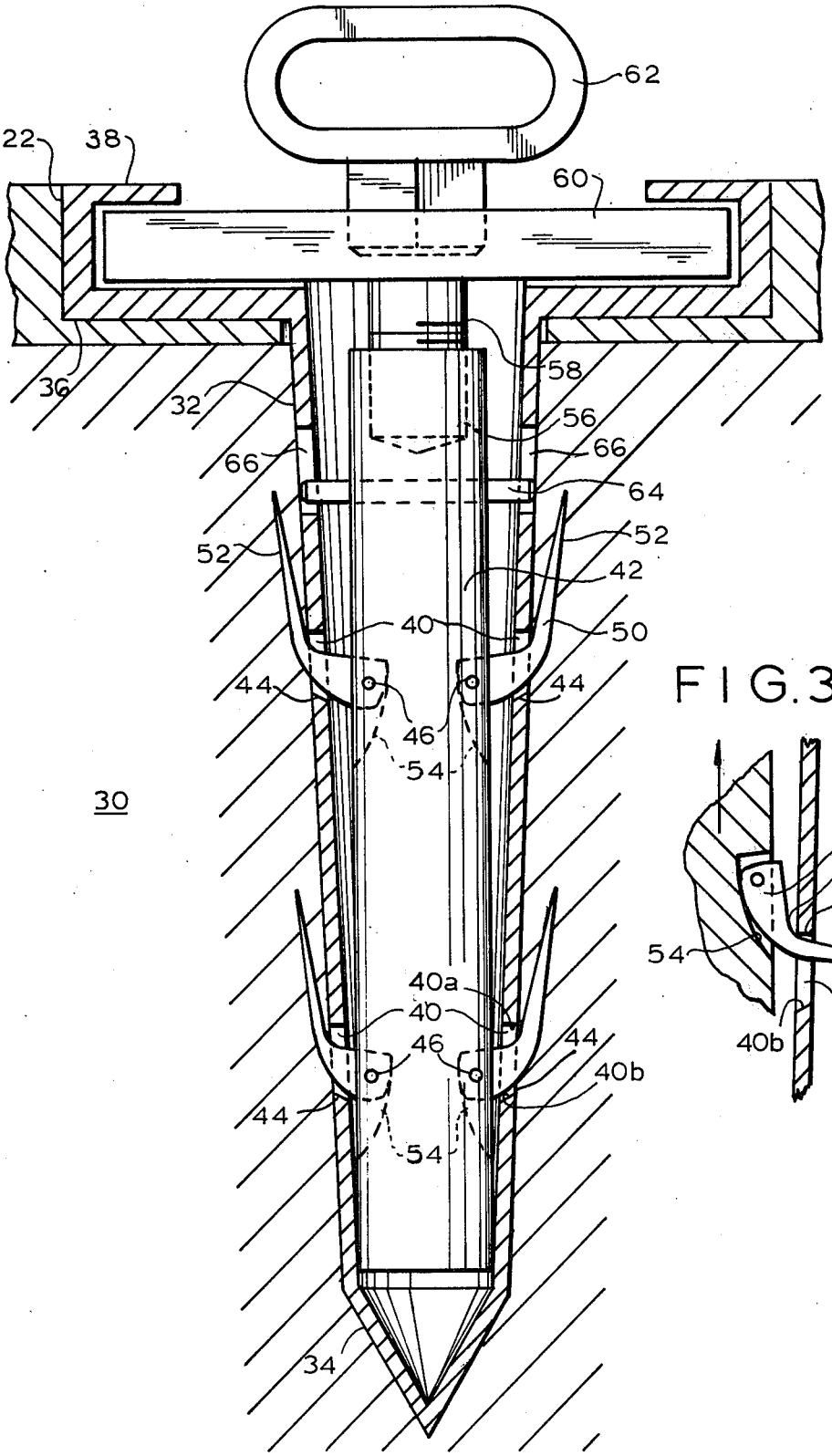
FIG. 2 is a cross-sectional elevation of the locking spike assembly of the embodiment of FIG. 1.
Figure 3:
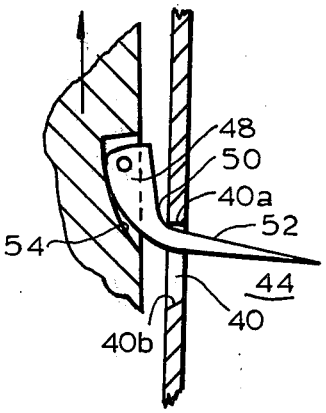
FIG. 3 shows detail of the device of FIG. 2 when the latter is disposed in an operative, anchoring position.

Details of the structure of the locking spike device 30 are shown in FIGS. 2 and 3.

The device 30 has a hollow body formed of a peripheral wall 32 having an insertion point 34 at the lower end thereof and a shoulder 36 to fit snugly in the recess 22 of the through opening 20. An annulus 38 closes off the top portion of the shoulder 36.

Holes or openings 40 are provided along the peripheral wall 32. An actuating slide 42 is displaceable within the hollow body of the device 30 and can be lowered to a first position as shown in FIG. 2 and raised to a second position as shown in FIG. 3.

A plurality of L-shaped locking spikes are provided to extend through the openings 40. These spikes 44 are pivotally mounted on pins 46 secured to the slide 42. Each of the locking spikes 44 has a base 48, an elbow 50, and an anchoring spade portion 52 which is disposed outside the peripheral wall 32. In this embodiment, four locking spikes 44 are provided in a two-above-two arrangement to achieve increased security when the locking spikes 44 are in their anchoring position (FIG. 3).

A recess 54 is provided in the slide 42 for each locking spike 44 and is dimensioned to corresponding to the shape of the base 48 thereof when the slide 42 is moved to the second position as shown in FIG. 3.

The slide 42 has a female-threaded top portion 56, and a corresponding male-threaded actuating member 58 is provided for engaging the threaded portion 56. A disk plate 60 held in the shoulder 36 beneath the annulus 38 is connected to this actuating member 58, and a twist handle 62 is affixed to the member 58 and the plate 60. In this embodiment, counter clockwise twisting of the twist handle 62 serves to lower the slide 42 to its first position (FIG. 2), while clockwise rotation of the twist handle 62 serves to raise the slide 42 to its second position (FIG. 3).

In order to prevent twisting of the slide 42 itself, an anti-twist mechanism is provided including an anti-twist pin 64 extending transversely from the slide 42 and a pair of recesses 66 in the wall 32 overfitting ends of the pin 64. These recesses 66 are narrow and elongated, and permit longitudinal motion only of the pin 64 and slide 42 between the first and second positions thereof.

The operation of the locking spike device 30 can be described briefly as follows:

If the twist handle 62 is rotated counter clockwise, the slide 42 is moved to its first position, and the anchoring spade portions 52 of the locking spike 44 are disposed in a retracted position as shown in FIG. 2 at or near the surface of the peripheral wall 32. In this position, the picnic chest 10 can be placed on sand or soft soil S, and the locking spike device 30 can be easily inserted into the sand or soft soil S. Then, as the twist handle 62 is rotated clockwise, the slide 42 moves to its second position, and the spade portions 52 of the locking spikes 44 are angled outward away from the peripheral wall 32. Here, as shown in FIG. 3, the elbow 50 of each of the locking spikes 44 contacts a top limit 40*a* of the respective opening 40 to ensure that the locking spike 44 is projected to its angled, anchoring position.

When the device 30 is in its anchoring position, it is quite difficult to pull the device 30 from the soft soil or sand S, and this fact will deter casual thieves from carrying off the picnic chest 10, even though the same may be unattended. Accordingly, clothing and valuables can be secured in the chest 10 by the lock 16 on the lid 14.

When it is desired to remove the picnic chest 10, for example, at the end of a day at the beach, the lid 14 of the chest can be opened, and the twist handle 62 turned counter clockwise. This returns the slide to its first position, with the spade portions 52 of the locking spikes 44 withdrawn, as shown in FIG. 2. The bottom of the elbow 50 contacts a bottom limit 40*b* of the opening 40, and the latter acts as a fulcrum to urge the locking spike to its withdrawn position. Then, the device 30 can be easily withdrawn from the sand or soft soil S and the chest 10 can be lifted and carried.

Figure 4:
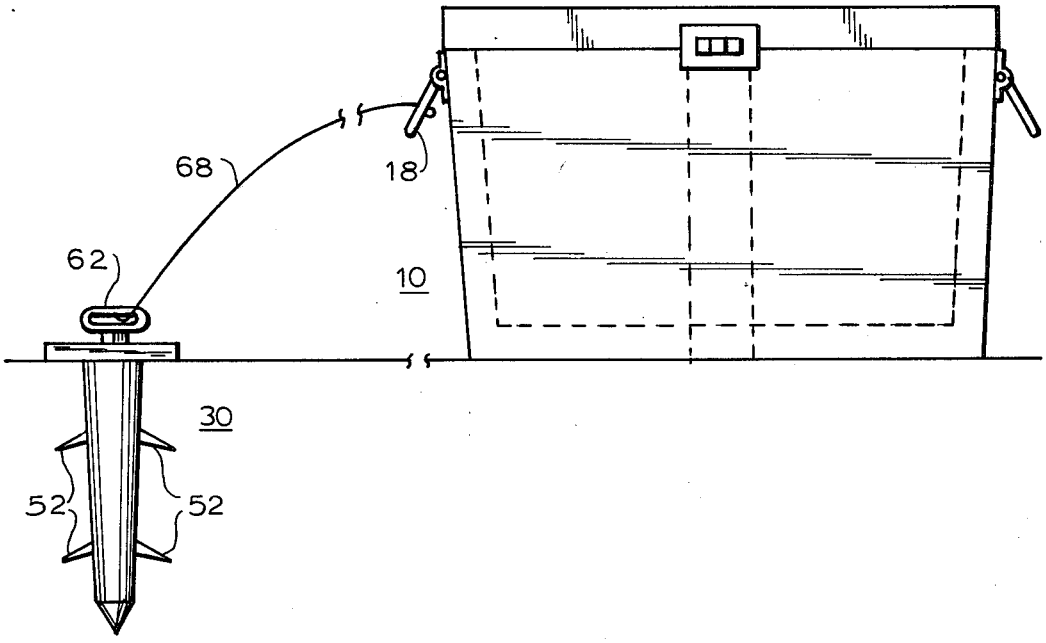
FIG. 4 illustrates an alternative arrangement of the picnic chest and locking spike device combination of this invention.

Another possible arrangement of the chest 10 and the locking spike device 30 is shown in FIG. 4. In this case, the device 30 is provided separately from the chest 10, and the latter is secured by means of a cable lock which passes through the twist handle 62 of the device 30 and also through one of the handles 18 of the chest 10. Although not shown in FIG. 4, a mechanism is provided to prevent the twist handle 62 from being rotated counter clockwise when the cable lock 68 is in place.

Of course, while a preferred embodiment has been shown and described hereinabove with reference to the drawings, many modifications and variations thereof will present themselves to those skilled in the art without departure from the scope and spirit of this invention as defined in the appended claims.

What is claimed is:

1. A securable beach picnic chest assembly comprising, in combination, a picnic chest having a floor, a closable lid, locking means for locking said lid, and carrying handles, with the chest being constructed to be of sufficiently light weight to be hand-portable, and with the floor having a through opening; and a locking spike device extending through said through opening and including a body portion, an insertion point at a lower end of the body portion, a shoulder at an upper end of the body portion securing the picnic chest to the locking spike device, a plurality of locking spikes having at least anchoring portions thereof disposed outside said body portion, slide means within said body portion coupled to said locking spikes and displaceable between first and second operative positions, and an actuator handle within said picnic chest and operative selectively to displace said slide means to said first position in which said anchoring portions of said locking spikes are disposed against said body portion so that said locking spike device can be inserted into and withdrawn from sand or soft soil, and to said second position in which said anchoring portions of said locking spikes are angled outwardly from said body portion to anchor said locking spike device and picnic chest in place in the sand or soft soil.

2. A securable beach picnic chest assembly as claimed in claim 1, wherein said through opening is centrally disposed in the floor of said picnic chest.

3. A securable beach picnic chest assembly comprising, in combination, a picnic chest having a floor, a closable lid, locking means for locking the lid, carrying handles, and a centrally-disposed through opening in said floor; and a locking spike device including an elongated body portion extending downward through said through opening and having insertion point means at the bottom thereof to facilitate insertion of the device into sand or soft soil, shoulder means on the top of the body portion engaging the floor of said chest, a plurality of anchoring spikes along said body portion selectively movable between a retracted position in which the device can be inserted into and removed from the sand or soft soil and an extended position in which the device is anchored in the sand or soft soil, and actuating means actuable within said chest when the lid thereof is open for selectively moving said anchoring spikes between said retracted and extended positions.

4. A locking picnic chest assembly which can be secured on sand or soft soil, comprising a chest having a floor, a closable lid, and locking means for locking said lid, the floor having a through opening; and a locking spike device extending through said through opening in the floor of the chest and insertable into soft soil or sand to be selectively anchored therein to secure said chest, the locking spike device including a hollow body portion having an insertion point at a lower end thereof, a peripheral wall with a plurality of openings, the peripheral wall being dimensioned to fit the through opening in said chest floor, and a projecting shoulder at an upper end thereof; a slide longitudinally displaceable within said body portion between first and second positions; a plurality of locking spikes extending through respective ones of said openings in said peripheral wall, each having a base portion pivotally secured to said slide and an anchoring spade portion external of said body portion such that in the first position of said slide said anchoring spade portions are in a withdrawn position against the outside of said peripheral wall and in the second position of said slide said anchoring spade portions are in an extended position angled outwardly from said peripheral wall; and actuator means disposed at said upper end of said locking spike device and within said chest for selectively displacing said slide into its first position for insertion and withdrawal of said device into and from sand or soft soil, and into its second position for anchoring said device in the sand or soft soil.

5. A locking picnic chest assembly as claimed in claim 4, wherein said actuator means includes a twist handle within said chest having a thread arrangement thereon interfitting a complementary thread arrangement on said slide; and anti-twist means are provided on said slide to permit longitudinal displacement only of said slide, in response to rotation of said twist handle, between said first and second positions.

6. A locking picnic chest assembly as claimed in claim 4, wherein said chest includes carrying handles and is constructed of rigid light-weight material so as to be hand-portable.

7. A locking spike assembly of a type which can be inserted into soft soil or sand and can be selectively anchored therein, comprising a hollow body portion including an insertion point at one end thereof, a peripheral wall having a plurality of openings, and securing means at another end thereof for securing objects thereto; a slide longitudinally displaceable within said body portion between first and second positions; a plurality of locking spikes each extending through a respective one of said openings and having a base portion pivotally secured to said slide and an anchoring spade portion external of said body portion such that in the first position of said slide said anchoring spade portions are in a withdrawn position against the outside of said peripheral wall and in the second position of said slide said anchoring spade portions are in an extended position angled outwardly from said peripheral wall; and actuator means at said other end of the body portion for selectively displacing said slide into its first position for insertion and withdrawal of said locking spike arrangement and into its second position for anchoring said locking spike arrangement.

8. A locking spike assembly as claimed in claim 7, wherein there are provided at least two sets of said locking spikes, the sets disposed at different longitudinal positions on said slide.

9. A locking spike assembly as claimed in claim 7, wherein said selecting means includes a rotatable screw member threaded to mate with a threaded portion of said slide to displace said slide upon rotation of the screw member, and said slide includes anti-twist means permitting longitudinal motion of said slide between said first and second positions but preventing rotation thereof.

10. A locking spike assembly as claimed in claim 9, wherein said anti-twist means includes a pin affixed on said slide and extending transversely therefrom; said body including longitudinal cut out means fitting said pin and permitting longitudinal motion only thereof between said first and second positions.

11. A locking spike assembly as claimed in claim 7, wherein said locking spikes are generally ell-shaped, with an elbow joining said base portion and said anchoring spade portion.

12. A locking spike assembly as claimed in claim 11, wherein said slide has cut-outs at position of said locking spikes and shaped to correspond to the shape of said base portions, so that in the extended positions of said locking spikes, said base portions are supported against said slide.

13. A locking spike assembly as claimed in claim 11, wherein said openings have limits at longitudinal ends thereof, and each said elbow abuts a respective one of the limits of its associated opening when said slide is in its first and second positions.

* * * * *